United States Patent [19]

Dyett et al.

[11] 4,372,327

[45] Feb. 8, 1983

[54] CUTTING HEAD FOR A CIGARETTE FILTER ATTACHMENT MACHINE

[75] Inventors: Derek H. Dyett; Neil Thorp, both of High Wycombe, England

[73] Assignee: Molins Limited, Bucks, England

[21] Appl. No.: 130,351

[22] Filed: Mar. 14, 1980

[30] Foreign Application Priority Data

Mar. 16, 1979 [GB] United Kingdom ..... 7909301
Dec. 11, 1979 [GB] United Kingdom ..... 7942620

[51] Int. Cl.[3] ..... A24C 5/56

[52] U.S. Cl. ..... 131/95; 83/344; 83/346; 83/347; 83/348; 83/506

[58] Field of Search ..... 83/346, 347, 348, 344, 83/506; 131/88, 91, 93, 94, 95, 58; 493/419

[56] References Cited

U.S. PATENT DOCUMENTS

| | | | |
|---|---|---|---|
| 1,393,524 | 10/1921 | Grupe | 83/348 |
| 3,089,695 | 5/1963 | Brooks | 493/419 |
| 3,407,691 | 10/1968 | Schlesinger | 83/344 |
| 3,731,575 | 5/1973 | Gelin | 83/348 |
| 3,777,607 | 12/1973 | Schofield | 83/506 |
| 3,800,640 | 4/1974 | Barrie | 83/346 |
| 3,828,637 | 8/1974 | Slack | 83/348 |

FOREIGN PATENT DOCUMENTS

| | | | |
|---|---|---|---|
| 164829 | 9/1958 | Switzerland | 83/348 |
| 1000696 | 8/1965 | United Kingdom | 83/348 |

*Primary Examiner*—V. Millin
*Attorney, Agent, or Firm*—Antonelli, Terry and Wands

[57] ABSTRACT

A cutting head for a cigarette filter attachment machine, for cutting a filter attachment web at regular intervals in cooperation with a cutting drum comprising a rotary member which carries one or more knives and is mounted on a movable carrier so as to be movable towards and away from the cutting drum, and including a fluid-powered actuator which is arranged to urge the cutting head towards the cutting drum.

12 Claims, 5 Drawing Figures

CUTTING HEAD FOR A CIGARETTE FILTER ATTACHMENT MACHINE

This invention is concerned with a cutting head for a filter attachment machine, which is a machine for making filter cigarettes by joining filter portions to tobacco rods by means of uniting bands. These bands are cut from a web of filter attachment material which is often of cork-like appearance and is for that reason usually referred to as "cork".

A common form of cutting head comprises a drum carrying a number of circumferentially spaced knives which cooperate with anvil inserts in a drum carrying the cork web, each cut being achieved by a pinching action. In one common cutting head, each individual knife is pivotally mounted on its carrier drum and is radially adjustable with respect to the axis of the drum. This allows the cutting edge of each knife to be set at a desired distance from the axis of the drum while the freedom of pivotal motion accommodates any lack of parallelism between the axis of the cutting head and that of the drum carrying the cork web.

There are normally fewer knives on the cutting head than anvils on the cork drum. Accordingly, it is not possible to set each knife so as to take account of any slight variation in regard to the distance of each anvil surface from the axis of the cork drum. Therefore the load of the knives on the anvils can vary, especially if the cutting drum is heated, as in the Molins PA8 filter attachment machine.

The same problem arises in connection with the cutting head described in Molins Limited British Pat. No. 1,469,684, in which each knife is secured to the cutting head, which is itself universally pivoted on its drive shaft.

According to this invention a cutting head for a cigarette filter attachment machine, for cutting a filter attachment web at regular intervals in cooperation with a cutting drum, comprises a rotary member which carries one or more knives and is mounted on a movable carrier so as to be movable towards and away from the cutting drum, and including a fluid powered actuator which is arranged to urge the cutting head towards the cutting drum.

In a preferred arrangement the movable carrier is in two parts supporting respectively the opposite ends of the cutting head, and there are two actuators acting respectively on the two parts of the carrier. The bearings at the ends of the cutting head may be ball bearings allowing slight tilting of the head axis with respect to the carriers, thus accommodating any slight lack of parallelism between the cutting edge of each knife and the cooperating anvil surface on the cutting drum. Each carrier preferably comprises an arm which carries one of the cutting head bearings at one end and is pivoted at the other end at a position such that the line between the pivot and the bearing is substantially at right angles to the direction in which the force of the actuator on the carrier is applied, which should be substantially radial.

The fluid-powered actuator (or each actuator) may be pneumatic; for example with a diaphragm on which the air pressure acts to transmit a force to a connecting rod extending from the center of the diaphragm. Alternatively, the actuator (or each actuator) may be powered by hydraulic fluid, for example oil, in which case the pressure of the hydraulic fluid may be derived from an air pressure source acting through an intensifier; between the intensifier and the or each actuator there is preferably a restrictor to restrict the flow of hydraulic fluid at least in the direction towards the actuator, and preferably only in that direction.

Examples of cutting heads according to this invention are shown in the accompanying diagrammatic drawings. In these drawings, FIGS. 1 and 2 are diagrammatic views of cutting heads using respectively pneumatic and hydraulic actuators;

Figure 1:
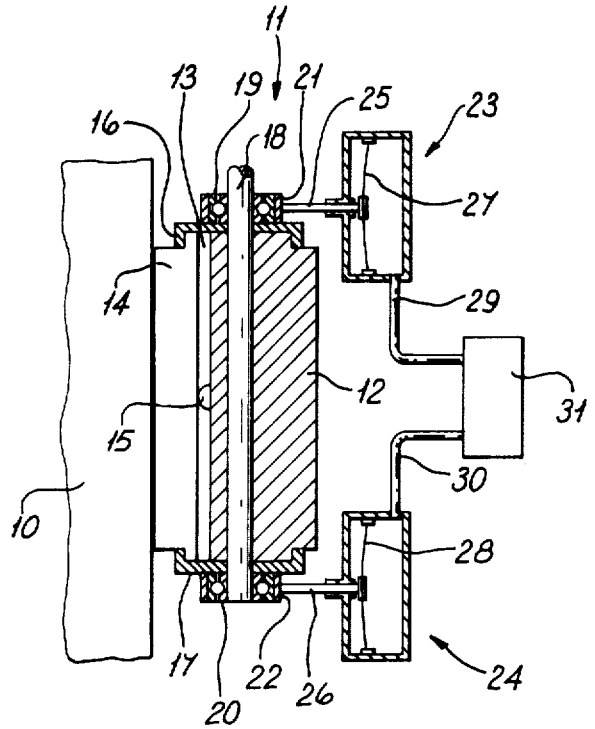

FIG. 1 shows part of a cutting drum 10 around which a filter attachment web is to be conveyed prior to cutting by means of a cutting head 11. The cutting head comprises a drum-like member 12 formed with, for example, five circumferentially spaced slots 13 containing knives 14.

Each knife 14 is capable of pivoting slightly with respect to the member 12 about a fulcrum 15; the knives are retained on the drum by flanged end plates 16 and 17.

A drive shaft 18 for the cutting head is mounted in ball bearings 19 and 20 within two separate carrier members 21 and 22. The position of each carrier member is controlled by a pneumatic actuator including a connecting rod 25 or 26 which is connected to the respective carrier member and to a diaphragm 27 or 28 in a surrounding cylindrical casing 23 or 24. Air at a controlled pressure is supplied to the actuators, on the side of the diaphragm opposite to the connecting rod, through a pipe 29 or 30 from a controllable source 31; the air pressure supplied to the respective cylinders may be separately controllable.

Control of the air pressure allows the cutting head to be moved towards the drum 10 through a variable distance. During use, this distance is set so that there is an appropriate amount of interference between each knife and the cutting drum during cutting, giving a cutting force dependent partly on the air pressure in the actuators and partly on the mass of the cutting head and the associated parts whose inertia will determine the force on the knife as they are moved slightly away from the cutting drum 10 during cutting. The mass of the cutting head and associated parts is preferably as small as possible to allow the cutting force to be determined to the greatest possible extent by the air pressure.

Conventional ball bearings permit slight tilting motion of the shaft with respect to the surrounding carrier. Such tilting motion in the present invention may be sufficient to allow the cutting head to accommodate any initial lack of parallelism between the cutting edge of each knife and the cooperating anvil surface on the cutting drum. In that case, each knife may be non-pivotably secured to the member 12, possibly with a resilient backing.

Figure 2:
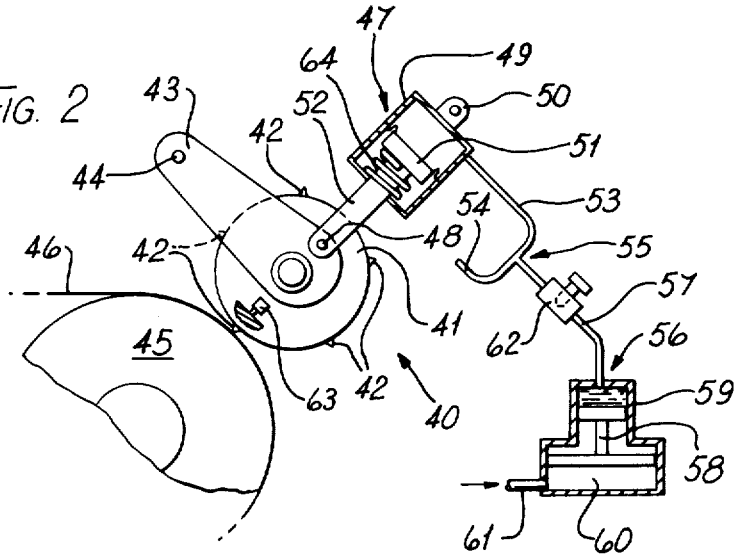

In the alternative arrangement shown in FIG. 2, a cutting head 40 comprises a drum-like member 41 carrying knives 42. At each end of the cutting head there is a carrier member in the form of an arm 43 which is approximately tangential to the drum 45 and is pivoted by a pin 44 to a fixed framework (not shown) so that the cutting head is free to move towards and away from a cutting drum 45 around which a filter attachment web 46 passes in order to be cut at regular intervals.

Each of the carrier arms 43 is pivoted to an hydraulic actuator 47 by a pivot pin 48. The actuator comprises a cylinder 49 pivoted by a pin 50 to a fixed framework (not shown), a piston or diaphragm 51, and a connecting rod 52 which extends from the piston or diaphragm and is pivoted to the carrier 43 by pin 48.

Each of the actuators is powered by hydraulic fluid fed respectively through pipes 53 and 54 which meet at a junction 55 connected to a pressure intensifier 56 by a supply pipe 57. The pressure intensifier 56, which may be of any known type, includes a piston assembly 58 which separates the hydraulic fluid (contained in a smaller cylinder 59) from a larger diameter air chamber 60 into which compressed air is fed through an inlet pipe 61. In this way the hydraulic pressure is derived from air pressure, which can readily be obtained from a factory supply and need not be as great as the required hydraulic pressure. The air inlet 61 preferably includes a pressure control device of any known kind.

An adjustable restrictor 62 is included in the pipe 57. This may act bidirectionally, but is preferably unidirectional, allowing substantially unrestricted flow in one direction (from the junction 55 to the intensifier 56) and restricted flow in the reverse direction; an example of such a device 15 part FC1 made by Air Automation Ltd.

In place of the restrictor or other device 62 in the pipe 57 (or in addition thereto) a similar unidirectional or bi-directional restrictor may be fitted in each of the branch pipes 53 and 54.

An adjustable stop 63 is mounted on a stationary framework (not shown) to engage each lever 43 so as to limit movement of the cutting head in the direction towards the drum 45. In practice we have found that the stops 63 need not be set very accurately. They can be set so as to allow significant initial interference between the knives and the drum 45. However, a few seconds after the machine starts to run (during the usual slow start period), the cutting head moves away from the drum 45 and stabilises itself at a position in which there is just adequate interference to provide the necessary cutting force, which may typically be of the order of 120 pounds.

The pipes 53 and 54 are preferably resilient, or may include resilient sections, so that they can expand slightly to absorb the small surge of hydraulic fluid from the actuators during each cutting operation.

Figure 4:
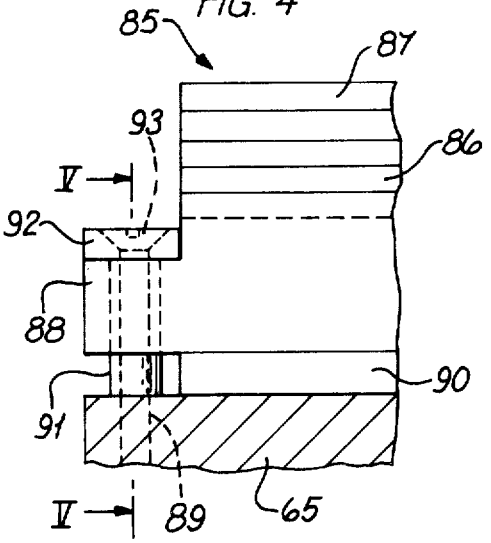
FIG. 4 is a longitudinal section through part of the cutting head.
Figure 5:
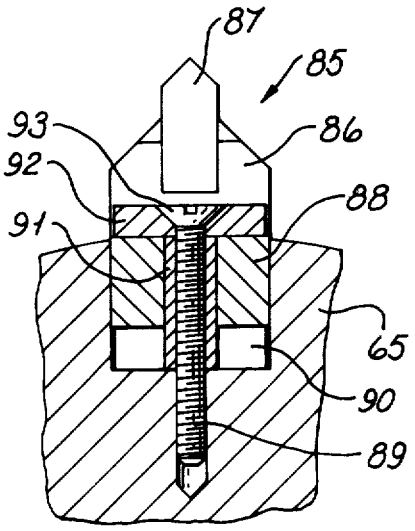
FIG. 5 is an enlarged cross-section on the line V—V in FIG. 4.

Each of the above knives 42 on the cutting head is preferably resiliently mounted so that it can move radially into the drum 41 against the resistance of a backing spring, e.g. of elastomeric material, during each cut. For example, any of the resilient knife mountings described in our British patent application No. 7912075 may be used. FIGS. 4 and 5 show another possible arrangement.

The air pressure supplied to the intensifier 56 may be automatically controlled so as to increase as the machine speed decreases, thus moving the cutting head further towards the drum 10 during successive cuts; this increases the interference between knife and drum and compensates for the lower inertia effect (slight movement back of cutting head during cutting) at low speeds of operation. The air pressure is preferably cut off or greatly reduced while the drum and the cutting head are running without web being in position on the drum; this saves unnecessary wear on the knives. A spring 64 in each cylinder 49 urges the piston 50 in the direction such as to lift the knives 42 clear of the drum 45.

Figure 3:
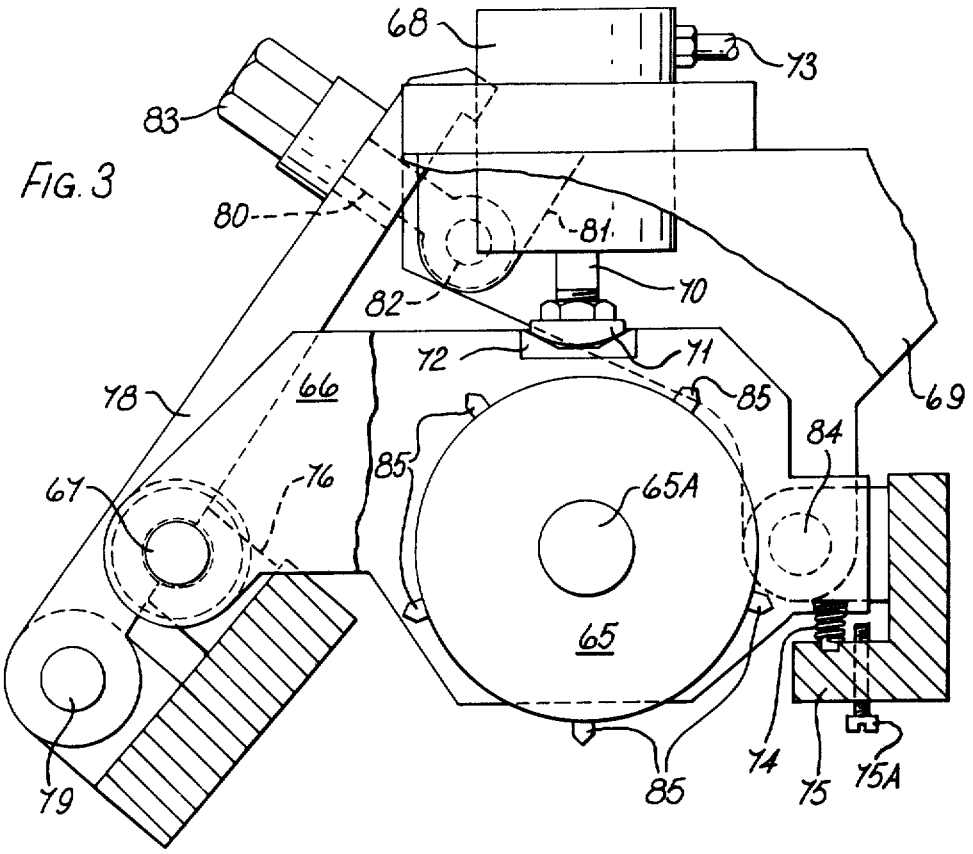
FIG. 3 shows a more complete design of a different cutting head.

FIG. 3 shows a different arrangement which is basically like FIG. 2. At each end of a cutting head 65 there is a carrier arm (of which the near one is partly removed in FIG. 3 for the sake of clarity) having ball bearings (not shown) supporting one end of a shaft 65A in the head 65. The arms 66 are both independently pivotally mounted on opposite ends of a pin 67.

Each arm 66 has an associated hydraulic actuator 68 (as in FIG. 2), but unlike the arrangement shown in FIG. 2, the cylinder of each actuator is rigidly mounted on a member 69 of which the near side is partly removed in the drawing to show the parts lying behind it. Each actuator has a piston rod 70 carrying a shoe 71 which engages in a slight recess in a hardened insert 72 in the corresponding arm 66. Hydraulic fluid under pressure is supplied to the actuator through pipe 73. In order to lift the cutting head slightly clear of the cutting drum (not shown) while the parts are rotating without web being fed between them, each arm 66 is engaged by a compression spring 74 carried by a part 75 of a fixed frame.

During use, the pin 67 is supported centrally in a socket in an upwardly extending lug 76 on a part 77 of a fixed frame. The pin is clamped in the socket by a central clamping arm 78 which is pivoted to the frame member 77 by a pin 79. At its other end the clamping arm 78 latches into a recess in the member 69 and is secured onto the latter by a bolt 80 which has its inner end pivoted to lugs 81 (on the member 69) by a pin 82. The bolt 80 passes through a longitudinal slot in the end of the arm 78, so that it can be swung clockwise off the arm once a nut 83 has been slackened. Thus the arm can be released to allow it to be swung counterclockwise about its pivot 79 to release the pin 67. Furthermore, the member 69 is pivoted at each end (i.e. at positions beyond the respective ends of the cutting head 65) by coaxial pins 84; thus it can be moved clockwise about the pins 84 to carry the actuators away from the carrier arms 66 to allow the cutting head 65 to be removed.

Movement of the cutting head towards the cutting drum is limited by adjustable stops 75A engaging the arms 66.

FIGS. 4 and 5 show how each of five knives 85 may be resiliently mounted in slots in the cutting head 65. Only one end of the knife is shown in FIG. 4, the other end being the same.

Each knife comprises a body 86 formed with a longitudinal groove in which a hardened cutting member 87 is secured, e.g. by brazing. At each end of the body 86 there is a flange 88 through which passes a screw 89 for securing the body in position. Below the body 86 there is a strip 90 of rubber or rubber-like material. This strip extends along the entire length of the body, apart from the flanges 88.

A spacer tube 91 around each screw 89 extends between the bottom of the groove containing the knife and a washer 92 engaged by the head 93 of the screw. The length of each tube 91 is such that, when the screw has been tightened, the rubber strip is precompressed to a predetermined extent. Thus the rubber strip provides a firm but resilient backing for the knife, allowing the knife to move inwards slightly during cutting, against the resistance of the rubber.

In any system according to this invention, there may be provision for slowly automatically increasing the fluid pressure to compensate for the decreasing sharpness of the knives.

The concept of using hydraulic actuators with one or more restrictors was described for the first time in British patent application No. 7942620, filed Dec. 11, 1979. The joint inventors thereof were the present applicants together with Godfrey Allen Wood.

We claim:

1. A cutting head for a cigarette filter attachment machine, for cutting a filter attachment web at regular intervals in cooperation with a cutting drum, comprising a rotary member which carries one or more knives protruding therefrom, each knife having a longitudinal cutting edge, means for rotating said rotary member, said rotary member being mounted on its opposite ends on two carrier members each of which is movable towards the cutting drum independently of the other carrier member so that movement of both carrier members towards the cutting drum ensures contact of each knife with the cutting drum along substantially the entire length of the knife, and including means for urging both carrier members towards the cutting drum so as to bias said rotary member toward said cutting drum and drive each knife repeatedly into contact with said cutting drum as said rotary member is rotated.

2. A cutting head according to claim 1 in which said urging means comprises two actuators acting respectively on the two carrier members.

3. A cutting head according to claim 2 including spring means for moving the rotary member away from the cutting drum when no fluid pressure is supplied to the actuators.

4. A cutting head according to claim 2 in which each carrier member includes bearing means which supports the corresponding end of the rotary member while allowing slight freedom for the axis of the rotary member to tilt with respect to the carrier member.

5. A cutting head according to claims 1, 2 or 4 in which each carrier member comprises an arm which has, at one end, a bearing supporting one end of the rotary member, and at the other end is pivotally mounted to allow the rotary member to move towards and away from the cutting drum.

6. A cutting head according to claim 5 in which a line joining the pivot of each arm and the axis of the rotary member is substantially at right angles to the direction in which the force of the urging means on the corresponding arm is applied.

7. A cutting head for a cigarette filter attachment machine, for cutting a filter attachment web at regular intervals in cooperation with a cutting drum, and comprising a carrier drum carrying at least one axially-extending knife protruding to a predetermined extent from the circumferential surfaces thereof and having a longitudinal cutting edge; supporting means for supporting said carrier drum with respect to said cutting drum to effect contact of said knife with said cutting drum including first and second carrier members connected to the respective ends of said carrier drum and means for mounting said first and second carrier members for movement towards and away from the cutting drum independently of one another; and means for urging said first and second carrier members toward said cutting drum so as to ensure contact of said knife with said cutting drum along substantially the entire length of the knife, including first and second fluid actuators acting on respective ones of said first and second carrier members and being interconnected to a common fluid pressure source.

8. A cutting head according to claim 7, wherein said first and second carrier members each comprise an arm which has, at one end, a bearing supporting one end of said carrier drum, and at the other end, is pivotally connected to said mounting means to allow said carrier drum to move towards and away from the cutting drum.

9. A cutting head according to claim 8, wherein said first and second fluid actuators are in contact with the respective arm forming said first and second carrier members so that a line joining the pivot of each arm and the axis of the carrier drum is substantially at right angles to the direction in which the force of each actuator on the corresponding arm is applied.

10. A cutting head according to claims 8 or 9, wherein said first and second fluid actuators are in contact with the respective arm forming said first and second carrier members so that the force of each actuator on the corresponding arm is applied along a line which extends substantially through the axes of said carrier drum and said cutting drum.

11. A cutting head according to claim 7, including spring means for biasing the carrier drum away from the cutting drum so that, in the absence of fluid pressure being supplied to said fluid actuators, the carrier drum will be moved away from said cutting drum.

12. A cutting head for a cigarette filter attachment machine, for cutting a filter attachment web at regular intervals in cooperation with a cutting drum, and comprising a rotary member which carries one or more knives each having a longitudinal cutting edge, characterized in that the rotary member is mounted at its respective ends on a movable carrier so as to be movable towards and away from the cutting drum, and including fluid-powered actuator means for urging the cutting head towards the cutting drum, means for supplying fluid pressure to the actuator means while the rotary member and cutting drum are rotating with filter attachment web fed between them to be cut, and spring members for moving the rotary member away from the cutting drum when no fluid pressure is supplied to the actuator.

* * * * *